US005286034A

United States Patent [19]

Haverkate et al.

[11] Patent Number: 5,286,034

[45] Date of Patent: Feb. 15, 1994

[54] DISC PITCHING GAME

[76] Inventors: Richard L. Haverkate; Diane L. Haverkate, both of P.O. Box 385, McQueeny, Tex. 78123

[21] Appl. No.: 917,230

[22] Filed: Jul. 23, 1992

[51] Int. Cl.[5] ..... A63B 67/06

[52] U.S. Cl. ..... 273/401

[58] Field of Search ..... 273/398, 400, 401, 402, 273/424, 425

[56] References Cited

U.S. PATENT DOCUMENTS

| | | | |
|---|---|---|---|
| 289,032 | 11/1883 | Sears | 273/409 |
| 2,050,914 | 8/1936 | Anderson | 273/425 X |
| 2,126,245 | 8/1938 | Darby | 273/400 X |
| 2,634,982 | 4/1953 | Gaede | 273/424 |
| 3,573,869 | 4/1971 | Duckett | 273/347 |
| 4,012,042 | 3/1977 | Blasingame | 273/401 |
| 4,805,916 | 2/1989 | Zentner | 273/386 |
| 5,040,801 | 8/1991 | Weymuth | 273/400 X |

FOREIGN PATENT DOCUMENTS 947323 1/1974 United Kingdom .

*Primary Examiner*—William H. Grieb

*Attorney, Agent, or Firm*—Richard C. Litman

[57] ABSTRACT

An apparatus and method for playing a game in which players throw discs made of a rubber composite material to oppositely placed boards with goal cups in the center. The goal cups are large enough to allow the entrance of the discs. At the bottom and center of each goal cup, a round protrusion allows the disc, once situated inside the goal cup, to be pressed at it's outer parameter, permitting the disc to be flipped up to facilitate grasping and removing. The game can be played by individuals or teams competing against each other in accordance with the rules of the game. The game is portable and safe, and can be played inside or outside without assembly.

3 Claims, 2 Drawing Sheets

DISC PITCHING GAME

BACKGROUND OF THE INVENTION

1. Field of the Invention

This invention relates to a disc pitching game of the same variety as horseshoes and quoits, and more particularly a game in which players attempt to throw and sink discs into round holes on playing fields.

2. Description of the Prior Art

Various patents have previously been issued which relate to discs or like objects being tossed at stationary targets for the purpose of playing a game.

Crawford G. Harrison and Christopher J. Harrison had their patent specification published in Great Britain on Jan. 22, 1964, G.B. 0947323, which disclosed a game that is similar to darts. The game consists of a board with various designs symbolizing targets for one to aim and throw at with rings or discs.

Charles Sears was issued U.S. Pat. No. 289,032 on Nov. 27, 1883. for a game having a target at which balls or projectiles are directed so that striking the target at selected locations scores points for a player.

Robert H. Gaede was issued U.S. Pat. No. 2,634,982 on Apr. 14, 1953, for a non-skid projectile in the form of a disc to be used in indoor or outdoor throwing games. The rim of the disc is made of soft vulcanized sheet rubber so that bouncing, skidding, or rolling can thus be avoided.

U.S. Pat. No. 3,573,869 was issued to John W. Duckett, on Apr. 6, 1971, for a game having a plurality of flexible discs of various sizes and colors. The object of this game is for one player to throw a disc to at least partially cover an opponent's disc. A player successful in covering his opponent's disc would be declared the winner.

Don R. Zentner, Jr., was issued U.S. Pat. No. 4,805,916 on Feb. 21, 1989, for a game that is an offshoot of horseshoes and quoits. This game uses one ball and a plurality of identical rings, wherein the ball is placed on or rolled into a prearranged area or playing surface. Players alternate turns at throwing the rings toward the ball in an attempt to encircle the ball with the rings.

None of these patents, whether taken singly or in combination, disclose the novel game apparatus and method of the present invention, as described herein.

SUMMARY OF THE INVENTION

This invention relates to a disc pitching game that is an offshoot of the game of horseshoes. Two players or teams of players throw discs made of a rubber composite material at oppositely-placed boards having goal cups or round holes in the center. The goal cups are large enough to allow the entrance of the discs. At the bottom and center of each goal cup is a round protrusion which allows the disc, once situated inside the goal cup, to be pressed at its outer parameter, permitted the disc to be flipped up to facilitate grasping and removing.

Accordingly, it is an object, advantage and feature of the invention to provide a novel game apparatus designed to play a challenging game of skill and luck.

It is another object, advantage and feature of the invention to provide a novel game apparatus which will allow players a moderate amount of stretching and bending exercise while playing a game using the apparatus.

It is still a further object, advantage and feature of the game to provide a novel game apparatus which enables a player to improve hand - eye coordination while playing the game.

It is still a further object, advantage and feature of the invention to provide for a novel game apparatus which is safe for players and spectators.

It is still a further object, advantage and feature of the invention to provide for a novel game apparatus which is portable, and can be played indoors and outdoors, and which has components which do not need assembly to play the game.

It is still a further object, advantage and feature of the invention to provide for a novel game apparatus having disc shaped components which are made of a rubber composite material so that they will flex on impact, yet not be wobbly when tossed.

It is still a further object, advantage and feature of the invention to provide a novel game apparatus including playing fields having rounded edges.. a flat surface, and a goal cup in the center thereof which is molded flush with the top surface.

It is yet another object, advantage and feature of the invention to provide a novel game apparatus wherein the goal cups of the playing fields are so constructed that when a disc is tossed into the goal cup, the construction of the goal cup permits the easy retrieval of the disc for further play.

These and other objects, advantages and features of the invention will become apparent from the description, drawing and claims herein.

Figure 2:
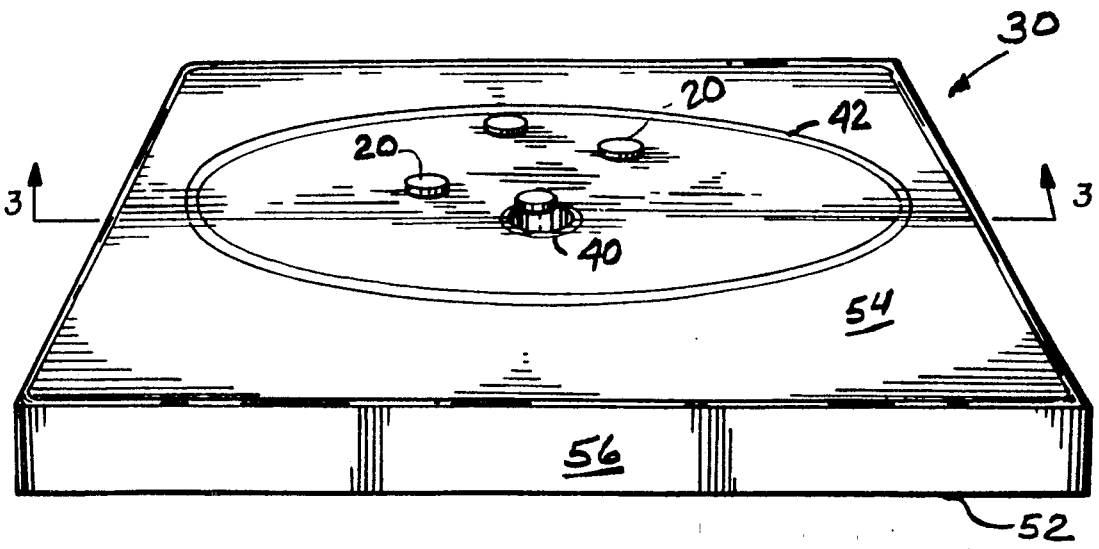
FIG. 2 is a perspective view of a playing field with discs on the field.

Reference numerals herein identify like components throughout the following description.

DETAILED DESCRIPTION OF THE PREFERRED EMBODIMENT

Figure 1:
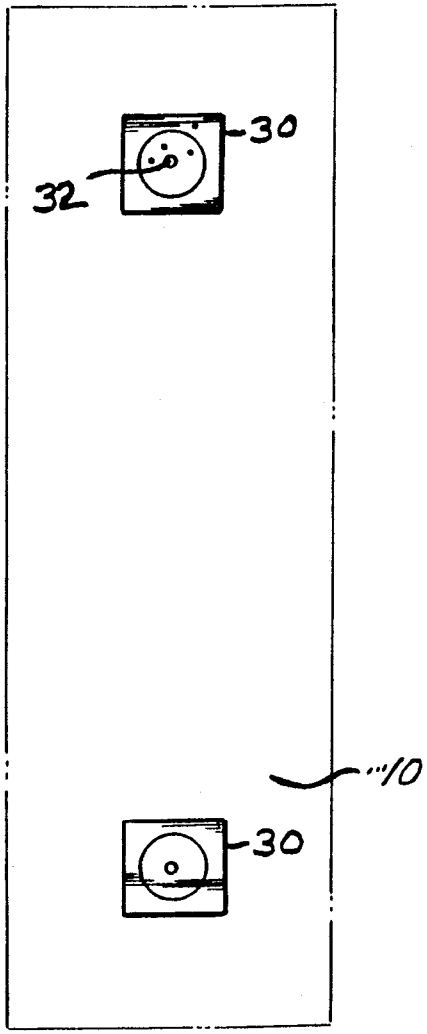
FIG. 1 is a top plan view of a representative court on which the game is played.

Referring now to the drawing, FIG. 1 shows court 10 which has a playing surface which is relatively flat, approximately ten feet wide and thirty feet long. At one end of court 10 is playing field 30 located about five feet from the end of court 10 centered from side to side. At the opposite end of court 10 is a like playing field 30 set up in the same way. Court 10 is laid out so that goal cups 32 are twenty feet apart. When more than one court is needed, such as may be required for tournament play, a buffer zone of two feet is provided between courts.

Figure 3:
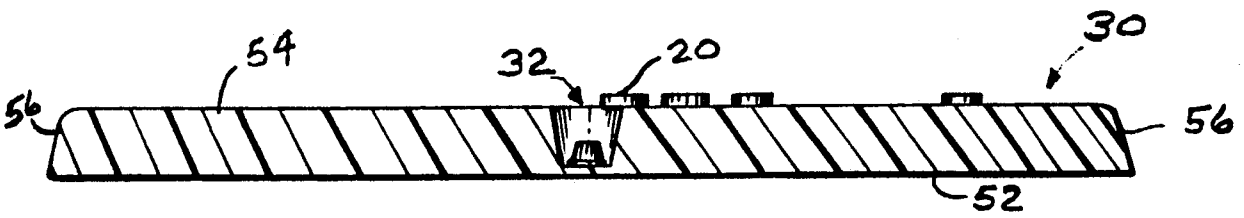
FIG. 3 is a side view of the playing field shown in FIG. 2.
Figure 5:
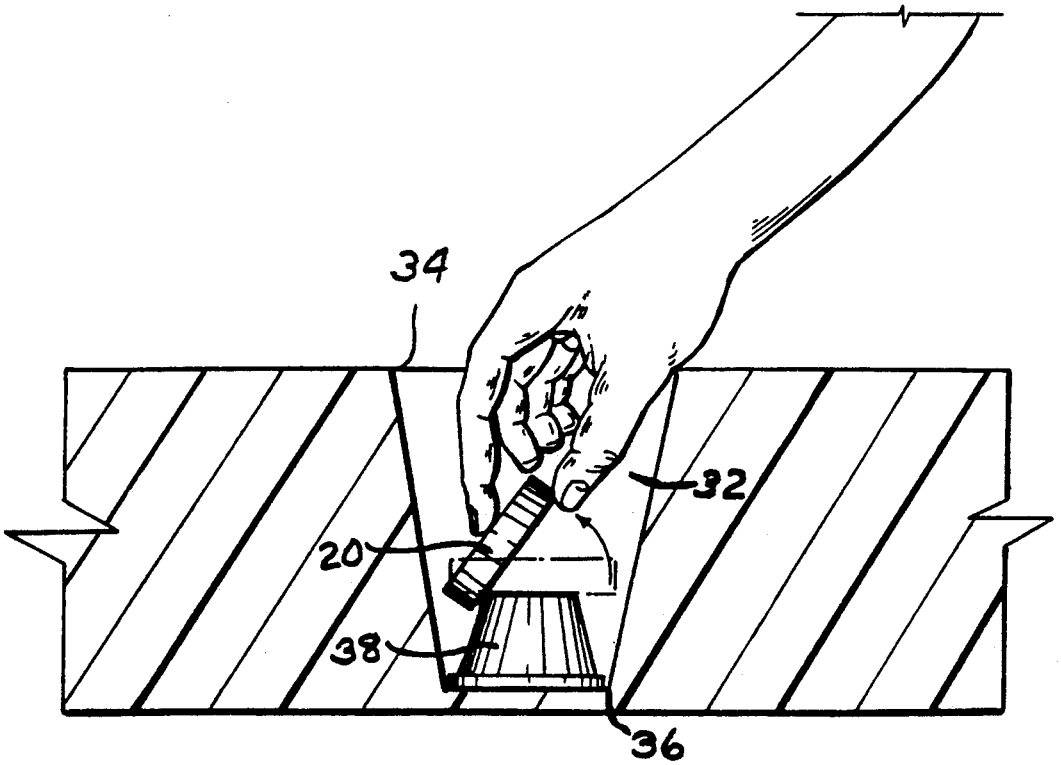
FIG. 5 is an enlarged view of the goal cup of the playing field shown in FIG. 3, wherein the disc shown in FIG. 4 is being retrieved from within the goal cup.

Two playing fields 30 are provided as Dart of court 10. As seen in FIGS. 2 and 3.. each field 30 i s twenty-four inches by twenty-four inches at its base 52, and twenty-three inches by twenty-three inches at its top surface 54. The edges of the playing field have all been rounded for safety. The height of the playing field 30 is two and three quarters inches, with a slope from top surface 54 to base 52 of one half inch on all four sides 56 thereof. The top surface 54 is flat, and constructed similar to that of a table top having a smooth surface. In the exact center of top surface 54 is a three inch cup, known as goal cup 32. Goal cup 32 is molded flush with the smooth top surface 54, as seen best in FIG. 3. And shown in FIG. 5 is an enlarged view of the goal cup showing a disc 20 being retrieved from within the goal cup.

Goal cup 32 has a three inch inside diameter at the top 34 and tapers to a two and one half inch inside diameter at the bottom 36. In the bottom 36 is molded a dome 38 which is two inches in diameter and five-eighths of an inch in height. Dome 38 is inside goal cup 32 to keep disc 20, known in the games as a "washoe", from getting trapped in bottom 36. As shown in FIG. 5, when a player reaches into goal cup 32 to retrieve disc 20, disc 20 will tip up, making it easy to remove from goal cup 32.

Located on playing field 30 is a white ring 40 which is one-quarter inch wide and surrounds the goal cup 32. There is a second one-quarter inch wide white ring on playing field 30 which is called the "scoring zone"; this ring 42 has an inside diameter of twenty-two inches. Both rings 40 and 42 are flush with the smooth top surface 54 of playing field 30. Playing field 30 can be made from any suitable, durable material, such as plastic, rubber, metal or wood.

Figure 4:
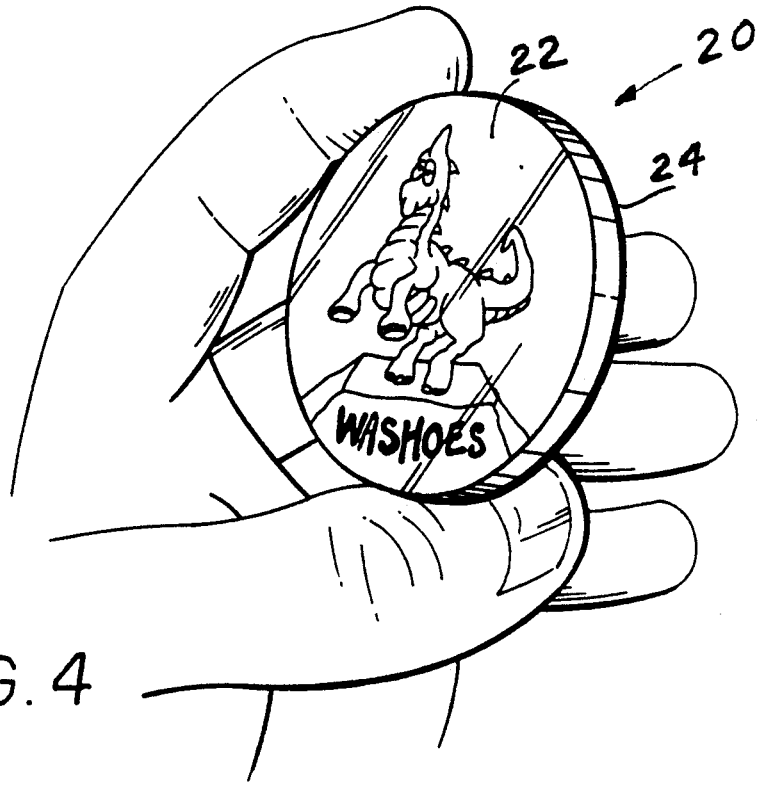
FIG. 4 is a perspective view of a disc used in playing the game.

Disc 20, shown in FIG. 4, is made of a rubber composite material which is flexible on impact yet is not floppy when being pitched. Disc 20 has a two and one-quarter inch diameter and is one-quarter inch thick. Disc 20 has a flat top 22 and flat bottom 24; it has a solid molded construction and does not have any holes, indentations or protrusions. Affixed on one surface can be a logo or design as desired. In the preferred embodiment, the word "washoes" and a fanciful depiction of a creature is shown on disc 20, consistent with the theme of the game wherein the game originates from the footprints left by a creature and discs were tossed into the footprints to play a game. Likewise, the same creature shown on disc 20 may be placed in opposite corners of the playing field on top surface 54.

The game begins by using the "LAG" method to select who will start the game. One player will pitch one disc 20 toward the far goal cup 32, and then the next player does the same. The player whole disc 20 comes to rest closest to the goal cup 32 may pick the end of court 10 they want to pitch from and pitch the first set or discs 20, which will include four discs. The other player(s) will go to the opposite end of court 10 and pitch from that end.

The starting player will Ditch his or her set of four discs 20, one at a time towards the far goal cup 32. After the set is pitched, both players check the position of the discs and count the score, as discussed herein. Note, discs 20 should not be removed until after the score has been counted. After the score is calculated, the second player pitches a set of four discs 20 to his or her goal cup 32 at the far end of the court. The score is checked and counted as before and the game continues with both players pitching back and forth from their end of the court until one reaches an exact score of twenty-one points. That player wins the game.

One point is gained for a "pointer", wherein disc 20 comes to rest within ring 42 on playing field 30. Three points are gained for a "Peeker" which is when a disc 20 comes to rest over the edge of goal cup 32, with enough of disc 20 peeking over goal cup 32 to be touched or lifted with another disc 20 from inside goal cup 32. Five points are scored for a "dunker", which is when a disc 20 lands inside coal cup 32. Disc 20 may slide, roll or bounce in goal cup 32; any way is acceptable.

Two players per team and two teams per court (four players) can play the game. Members of the same team pitch from one end of the court against two players at the other end of the court. For team play, the starting team is selected in the same way that it would be if only two players are participating. On the starting team, one player will pitch two discs 20 and then the partner will pitch two. This is a "set". The score is counted the same as if it were two Players participating. Then, players on the other team each pitch two discs 20 toward the opposing goal cup 32. The score is counted, and the game continues until a winning score of twenty-one points is reached.

The game has ten basic rules:

1) the discs must be pitched underhand;
2) only one player may be on the court at a time;
3) a player may not step forward of the adjacent goal cup 32 when pitching to the far goal cup;
4) disc 20 must be pitched at least half way to the far goal cup 32 or the disc 20 must be pitched again;
5) disc 20 must be inside the ring 42 to score a point (some green, the color of the playing field 30 must be seen between disc 20 and ring 42);
6) an exact score of twenty-one points wins the game;
7) should a player go over twenty-one points, none of the points in that set will be counted and the same continues;
8) a "set" is four discs 20 being pitched;
9) a "round" is two sets; and
10) should both players, or teams, end up in a tie score of twenty-one points after an equal number of sets, a tie breaker playoff is necessary to determine who the winner is.

if a tie breaker is required, the following rules apply:

a) the player or team, that was first to pitch will start again with no score;
b) all four discs 20 must be pitched, and the score counted;
c) the opposing player, or team, also starts out with no score;
d) all four discs must be pitched and the score counted;
e) at the end of this round (2 sets), the player or team with the high score wins the game; and
f) if a tie score results again, another round is pitched until there is a winner (the game could never end with a tie).

These are the basic rules of play in utilizing the apparatus of the game. The components, method of play, and other aspects of .I the game, described herein, are examples of the preferred embodiment of the game. Other embodiments of the game within the spirit of the appended claims are considered within the scope of the invention.

We claim:

1. A game for one or more players, comprising:

a disc;

at least one solid target platform including a top surface, said top surface having a depression therein;

said depression having a depression top and a depression base, said depression top being wider than said depression base, said depression base including a protrusion, said protrusion having a protrusion top and a protrusion base, said protrusion top being narrower than said protrusion base, and said protrusion top being substantially flat; whereby when said disc is tossed into said depression, said disc is guided to and seated on said protrusion top to facilitate easy removal of said disc.

2. A game as defined in claim 8, comprising:

a first and second target platform, and a plurality of discs;

said first and second target platforms being located at opposing ends of a court, said court being approximately 20 feet long and 10 feet wide.

3. A game as defined in claim 1, wherein said discs are comprised of flexible material.

* * * * *